United States Patent [19]

Schapira et al.

[11] 4,311,536

[45] Jan. 19, 1982

[54] PROCESSES OF PHOSPHATING SURFACES OF IRON AND OF STEEL WITH MANGANESE

[75] Inventors: Joseph Schapira, Paris; Victor Ken, Colombes; Jean C. Masson, Le Perreux; Francois J. Duboys, Le Plessis Robinson, all of France

[73] Assignee: Compagnie Francaise de Produits Industriels, Gennevilliers, France

[21] Appl. No.: 165,763

[22] Filed: Jul. 3, 1980

[30] Foreign Application Priority Data

Jul. 6, 1979 [FR] France ..... 79 17687

[51] Int. Cl.[3] ..... C23F 7/10

[52] U.S. Cl. ..... 148/6.15 R; 252/135; 252/156; 252/173; 252/174.25

[58] Field of Search ..... 148/6.15 R; 252/80, 252/133, 135, 156, 173, 174.25

[56] References Cited

U.S. PATENT DOCUMENTS

| | | | |
|---|---|---|---|
| 2,516,008 | 7/1950 | Lum | 148/6.15 Z |
| 3,510,365 | 5/1970 | Rausch et al. | 148/6.15 R |

*Primary Examiner*—Ralph S. Kendall

*Attorney, Agent, or Firm*—Fleit & Jacobson

[57] ABSTRACT

The invention relates to a process of phosphating surfaces of iron and of steel with manganese.

The abovesaid process is characterized by the fact on the one hand, that it does not include a refining treatment preceding the proper phosphating, and on the other hand, that the alkali degreasing bath has a pH of 9 to 12 and includes in suspension bivalent manganese in orthophosphate form.

12 Claims, No Drawings

PROCESSES OF PHOSPHATING SURFACES OF IRON AND OF STEEL WITH MANGANESE

The invention relates to improvements in processes for phosphating surfaces of iron and of steel with manganese.

The uses of this type of phosphating occur particularly in the automobile, armaments and conventional engineering industries.

The surfaces to be phosphated are subjected, within the scope of said processes, to the following successive processing steps:

alkali degreasing, rinsing, refining treatment by means of phosphate solutions, notably of Mn, proper phosphating processing, rinsing followed by drying.

The refining treatment is indispensable to obtain, after the alkali degreasing, a coating of fine, dense and regular crystals in the course of the proper phosphating step with manganese.

Now, this refining treatment is expensive due to the very fact that it constitutes a particular step and because of the need to renew the refining bath frequently.

It is therefore a particular object of the invention to overcome this drawback and to provide an improved process for phosphating iron and steel with manganese which, whilst no longer including therein the refining step, enables the production of a satisfactory phosphate coating even after the alkali treatment.

Now, we have found quite surprisingly and unexpectedly, that it is possible to eliminate the refining step due to the incorporation, made possible through its researches, in the alkali degreasing bath, of $Mn^{++}$ orthophosphate suspensions placed initially in operation in the course of the refining step.

The phosphating process of the steel and iron surfaces with manganese previously degreased in an alkali bath is characterized by the fact, on the one hand, that it does not include a refining treatment preceding proper phosphating and, on the other hand, that the alkali degreasing bath has a pH of 9 to 12, preferably of 10 to 11.5, and includes bivalent manganese in suspension in the form of orthophosphate, of fine particle size, preferably less than 100$\mu$ and, even more preferably, less than 50$\mu$, at a concentration higher than 0.5 g/l, preferably from 4 to 7 g/l.

In an advantageous embodiment of the abovesaid process, the alkali degreasing bath includes, besides the bivalent manganese:

an alkali agent selected from the group comprising soda, borates, silicates (meta- or ortho-), sodium orthophosphate, the nature and amount of alkali agent being selected so that the pH has the desired value, mostly around 10–11.5, but which cannot exceed 12 or drop below 9 according to the state of the surface to be degreased;

a surface-active agent, selected preferably from the group of surface-active agents of the anionic or nonionic type, the nature and amount of detergent agent being determined according to the state of the surface to be degreased and the form of application (by a jet or dipping) of the bath; generally, the amount of surface-active agent is comprised between 1 and 10 g/l, and preferably, a sequestering agent for the $Ca^{++}$ ions of the water, selected notably from among condensed phosphates, in a proportion preferably less than 10 g/l.

Besides, the invention relates to the abovesaid degreasing baths, as new industrial products, as well as to the "concentrates", that is to say mixtures in powder form of the constituent ingredients of these baths, in respective proportions such that, by solution and/or suspension of the mixtures concerned in a suitable amount of water, said baths are reconstituted.

Apart from the above-mentioned features, the invention relates also to other features which will be more explicitly discussed below.

It will, in any case, be well understood by means of the additional description and examples which follow.

Iron or steel parts, in order to be coated by coating of manganese phosphate, are treated in a conventional bath for manganese phosphating after having been subjected, in accordance with the process according to the invention, to an alkali degreasing at pH 9–12, preferably 10–11.5, in the presence of $Mn^{++}$ in the form of orthophosphate and without intermediate refining treatment between the degreasing and the phosphating; the latter is followed by rinsing with water and subsequent drying.

The whole of the process hence includes the following steps:

refining alkali degreasing according to the invention;

rinsing;

phosphating proper;

rinsing and drying.

The degreasing bath according to the invention is prepared by disolving into water the amount of alkali agent necessary to bring the pH to 10–11.5 preferably.

The alkali agent is generally constituted by soda, borates, silicates (ortho- or meta-), sodium orthophosphate, or mixtures of the compounds concerned.

The proportion of silicates is always selected at a value less than about 15 g/l, because of their influence on the pH.

The $Mn^{++}$ orthophosphate present according to the invention, is added in the proportion of at least 0.5 g/l, preferably in the proportion of 4 to 7 g/l. Except in special cases, concentrations higher than 10 g/l are to be avoided, notably because of the cost price and of the increasing difficulties of rinsing, and those less than 2 g/l are to be avoided because of the heterogeneity of the crystalline coating obtained at the end of the phosphating step.

The bath advantageously includes, in addition, a surface-active agent to increase the detergent power, this agent being selectable from the group comprising nonionic and anionic surface-active agents. It is generally present in an amount of 1 to 10 g/l.

In order to sequester the $Ca^{++}$ ions which can be present in the water, concentrated phosphates may be resorted to, notably tripoly- and pyrophosphates, in the proportion preferably less than 10 g/l to avoid any inhibition of the subsequent phosphating.

It is also possible, in certain cases, to include with the bath, and this by way of auxiliary detergents, an amount of sodium carbonate which must in any case remain less than 20 g/l to avoid the formation of heterogeneous crystals at the time of the phosphating in itself.

Preferably, the degreasing baths as thus described are formed from a "concentrate" constituted by a mixture of the various above-mentioned ingredients in powder form in proportions resulting from the foregoing numerical indications.

The alkali degreasing baths according to the invention are applied preferably with stirring when a soaking treatment is concerned.

The temperature of application of these baths on degreasing is from 40° to 100° C. and advantageously at 90° C. when they are applied by immersion; this temperature is advantageously from 40° to 70° C. for application by jet.

The baths are kept in contact with the parts to be degreased, in the case of a soaking operation, for about 10 to 20, preferably 15 minutes. With the jet, the contact time is shorter and, notably, about 1 to 5 minutes.

The subsequent phosphating in itself consists of treating the degreased parts for about 10 minutes in a phosphating bath at a temperature of about 95° C. containing, in solution, a sufficient amount of bivalent manganese, of phosphoric acid, of nitric acid and, preferably, as catalyst, a small amount of nickel nitrate.

The final rinsing is carried out by means of water at ambient temperature and the drying by means of hot air, for example.

To illustrate the invention, some examples are given below.

Within the scope of these examples, steel specimens of LFQC type (that is to say "cold rolled of classical grade" such as found in the automobile industry) are subjected to phosphating in a manganese phosphate bath constituted by:

6.8 g/l of $Mn^{++}$,
30 g/l of $PO_4^{---}$,
1.8 g/l of $NO_3^{-}$,
0.1 g/l of $Ni^{++}$.

The treatment is continued for 10 minutes at 95° C.

The test specimens had been previously subjected for 15 minutes at 90° C. to degreasing baths whose composition is indicated below and which are denoted by Example 1 to Example 4.

EXAMPLE 1

Composition of the degreasing bath:

| | |
|---|---|
| soda | 50 g/l |
| sodium carbonate | 10 g/l |
| non-ionic surface-active agent of the CEMULSOL NP 10 brand (Rhone Progil Company) | 2 g/l |
| manganese orthophosphate | 5 g/l |

The pH of this bath was higher than 12.

EXAMPLE 2

Composition of the degreasing bath:

| | |
|---|---|
| sodium metasilicate | 5 g/l |
| borax | 50 g/l |
| sodium tripolyphosphate | 5 g/l |
| CEMULSOL NP 10 | 2 g/l |
| manganese orthophosphate | 5 g/l |

The pH of the bath was from 10 to 11.

EXAMPLE 3

Composition of the degreasing bath identical with that of Example 1, plus an additional amount of soda:

| | |
|---|---|
| soda | 30 g/l |

The pH of the bath was higher than 12.

EXAMPLE 4

Composition of the degreasing bath:

| | |
|---|---|
| borax | 50 g/l |
| CEMULSOL NP 10 | 20 g/l |
| manganese orthophosphate | 2 g/l |

The pH of the bath was 9.

After the rinsing and drying subsequent to the phosphating the constituent crystals of the phosphate coating formed were examined. The results of the observations are collected in Table I in which there is also indicated the quality of the degreasing.

TABLE I

| | Quality of degreasing | Appearance of the phosphating |
|---|---|---|
| Example 1 | good | heterogeneous coarse crystals |
| Example 2 | good | homogeneous fine crystals |
| Example 3 | good | heterogeneous average sized crystals |
| Example 4 | average | very fine but heterogeneous crystals |

It follows from this Table that it is advantageous to carry out the degreasing treatment according to the invention under the aforesaid preferred conditions (those of Example 2).

As a consequence of which and whatever the embodiment adopted, there is thus provided a phosphating process with manganese whose characteristics emerge sufficiently from the foregoing for it to be unnecessary to dwell further on this subject and which have, with respect of those pre-existing, numerous advantages, notably that of being less expensive and polluting due to the fact that it no longer includes a refining step.

As is self evident and as emerges already from the foregoing, the invention is in no way limited to the methods of application and embodiment which have been more particularly envisaged; it encompasses, on the contrary, all modifications.

We claim:

1. A process for phosphatizing of metal surfaces of steel or iron with manganese which comprises the following successive processing steps:

contacting the metal surface with an aqueous alkaline degreasing bath having a pH from about 9 to 12 and comprising in suspension, a concentration of bivalent manganese in the form of orthophosphate greater than 0.5 g/l, said bivalent manganese orthophosphate having a particle size less than 100μ;

rinsing the metal surface;

contacting the metal with a phosphatizing bath; and rinsing and drying the phosphatized metal surface.

2. The process of claim 1, wherein the alkaline degreasing bath has a pH from 10 to about 11.5.

3. The process of claim 1, wherein the degreasing bath includes bivalent manganese in the form of orthophosphate at a concentration from about 4 to 7 g/l.

4. The process of claim 1, wherein the alkaline degreasing bath contains bivalent manganese in the form of orthophosphate having a particle size less than 50μ.

5. The process of claim 1, wherein the alkaline degreasing bath has a pH of about 10 to 11.5 and includes bivalent manganese having a particle size less than 50μ and a concentration of about 4 to 7 g/l.

6. The process of claim 1, wherein the alkaline degreasing bath comprises:

an alkali agent selected from the group consisting of soda, borates, meta-silicates, ortho-silicates, and sodium orthophosphate, in amounts sufficient to maintain the pH at about 10 to 11.5; and a surface-active agent.

7. The process of claim 1, wherein the alkaline degreasing bath further comprises:

an alkali agent selected from the group consisting of soda, borates, meta-silicates, ortho-silicates, and sodium orthophosphate, in amounts sufficient to maintain the pH at about 10 to 11.5; and a surface-active agent selected from the group consisting of the ionic and non-ionic type.

8. The process of claim 1, wherein the alkaline degreasing bath comprises:

an alkali agent selected from the group consisting of soda, borates, meta-silicates, ortho-silicates, and sodium orthophosphate, in amounts sufficient to maintain the pH at about 10 to 11.5;

a surface-active agent selected from the group consisting of the ionic and non-ionic type; and a sequestering agent for the $Ca^{++}$ ions in the water selected from among the condensed phosphates, in a proportion less than 10 g/l.

9. The process of claim 1, wherein the alkaline degreasing bath comprises:

an alkali agent selected from the group consisting of soda, borates, meta-silicates, ortho-silicates, and sodium orthophosphate, in amounts sufficient to maintain the pH at about 10 to 11.5;

a surface-active agent, in a quantity comprised about between 1 and 10 g/l, selected from the group consisting of the ionic and non-ionic type; and a sequestering agent for the $Ca^{++}$ ions in the water, selected from among the condensed phosphates, in a proportion less than 10 g/l.

10. The process of claims 7, 8 or 9, wherein the manganese orthophosphate has a particle size less than 50μ and is present in a concentration of about 4 to 7 g/l.

11. An alkaline degreasing bath for metal surfaces comprising:

greater than 0.5 g/l of bivalent manganese in the form of an orthophosphate having a particle size less than 100μ;

an alkali agent selected from the group consisting of soda, borates, meta-silicates, ortho-silicates, and sodium orthophosphate, in amounts sufficient to maintain the pH at about 10 to 11.5;

a surface-active agent, in a quantity comprised between 1 and 10 g/l, selected from the group consisting of the ionic and non-ionic type; and a sequestering agent for the $Ca^{++}$ ions in the water, selected from among the condensed phosphates, in a proportion less than 10 g/l.

12. A powdered concentrate for making an alkali degreasing bath having a pH between about 10 to 11.5 for metal comprising:

4 to 7 parts by weight bivalent manganese in the form of an orthophosphate;

1 to 10 parts by weight of a surface-active agent selected from the group consisting of the ionic and non-ionic type;

0 to 10 parts by weight of a sequestering agent for $Ca^{++}$ ions in water; and an alkali agent selected from the group consisting of soda, borates, silicates, and sodium orthophosphate.

* * * * *